US006577558B1

(12) United States Patent
Ricci

(10) Patent No.: US 6,577,558 B1
(45) Date of Patent: Jun. 10, 2003

(54) WATCH

(76) Inventor: Giuseppe Ricci, Via Camarra 10, 66100 Chieti (IT)

( * ) Notice: Subject to any disclaimer, the term of this patent is extended or adjusted under 35 U.S.C. 154(b) by 0 days.

(21) Appl. No.: 09/674,623

(22) PCT Filed: Apr. 30, 1999

(86) PCT No.: PCT/IT99/00111

§ 371 (c)(1),
(2), (4) Date: Oct. 30, 2000

(87) PCT Pub. No.: WO99/57615

PCT Pub. Date: Nov. 11, 1999

(30) Foreign Application Priority Data

Apr. 30, 1998 (IT) ..... CH98A0004

(51) Int. Cl.[7] ..... G04B 19/04
(52) U.S. Cl. ..... 368/228; 368/80; 368/281
(58) Field of Search ..... 368/112, 220, 368/41, 44, 80, 228, 106, 223, 281

(56) References Cited

U.S. PATENT DOCUMENTS 1,500,071 A 7/1924 Blanke
3,696,609 A * 10/1972 Dubois ..... 368/220
4,228,644 A * 10/1980 Watanabe et al. ..... 368/28
6,351,435 B1 * 2/2002 Kronenberg et al. ..... 368/112

FOREIGN PATENT DOCUMENTS

EP 0 652 496 5/1995
JP 60227188 11/1985

OTHER PUBLICATIONS

Meyers, F.H.E., "Letters: SI Time," *Engineering*, vol. 28, Jul. 1969, pp. 50–51.

* cited by examiner

*Primary Examiner*—Vit Miska
*Assistant Examiner*—Jeanne-Marguerite Goodwin
(74) *Attorney, Agent, or Firm*—Ladas & Parry

(57) ABSTRACT

A watch (1) allows the identification and the division of three time periods over a day and comprises a dial (2); a hand member (3) having a movable pointing end (15); and a path (12), with respect to wich said movable pointing end (15) is moved, which is provided with an initial position (13; 13*a*) and a final position (13; 13*b*), wherein the run time of said path (12), from the initial position (13; 13*a*) to the final position (13; 13*b*), of said movable pointing end (15) is of eight hours, said watch (1) comprising identification means (18, 19; 20, 21, 22) of an 8-hour period corresponding to said path (12), capable of displaying three different time states (WT, FT, NT).

16 Claims, 3 Drawing Sheets

WATCH

BACKGROUND OF THE INVENTION

1. Field of the Invention

The present invention relates to a watch that, in its most general form, is of the type comprising a dial; at least one hand member having a movable pointing end; and at least a path, with respect to which said movable pointing end is moved, which is provided with an initial position and a final position.

2. Description of the Related Art

Several types of watch are known to the art, usually providing an information referring to time, expressed in an analogical or in a digital way.

In both cases, the watch structure is such that said information is provided either with a numerical progression, as e.g., in the normal digital watches having a digit display, or divided into two time intervals, each having a 12-hours length.

Moreover, examples of hand watches do exist wherein the hour hand performs a 24-hours length revolution onto a single dial, reporting the traditional 24-hours division inside two semicircles of 12 hours each.

This type of watch, although providing an accurate information, imposes to the users a division of time that does not coincide with the pace and uses of the daily life, which, although based on the day/night partition, is differently organized.

In fact, it is apparent that, in the traditional hand watches, the division of the possibly graduated path on said dial adopts as initial and final positions the position of midday and midnight, i.e., the climax of the day and the climax of the night.

It is well known that such positions respectively correspond to, more or less, the core of an individual's working life, imagining a normal working commitment which starts from 8.00 a.m. and lasts until 4.00 p.m., and to the middle of the night, at least from an astronomical standpoint.

In fact, in an age where the daily life was ruled by the light—dark, i.e., Sun—Moon succession, meant as the motion of a star onto the celestial vault, said traditional positions had a meaning related to the pace and uses typical of that age.

Hence, it was normal and natural for said astronomical motion, having an approximate length of 12 hours, without taking into account the seasonal variation, to be adopted to represent the time path of an entire day.

In the modern age, particularly with the artificial electric lighting, such a representation does not have a direct match anymore, and might give to the user impressions about his/her own daily life that are substantially contradictory and misleading.

Therefore, this division does not tally with the intermissions to which the individual activity of any user that wears, or anyhow benefits from the time information, is subjected.

Moreover, the division into intervals, even if due to specific structural peculiarities of the watch, does not suffice to divide in time the various activities of an individual user, that generally speaking can be divided into three time periods: working time period, 8.00 a.m. to 4.00 p.m.; free time period, 4.00 p.m. to midnight; and rest or sleeping period, midnight to 8.00 a.m.

BRIEF SUMMARY OF THE INVENTION

On this ground, EP 0,652,496 A discloses a watch which has a 12-hour dial comprising means for displaying time as measured in the "Ayurveda" philosophy. According to the latter, the 24-hour day is subdivided into six sub-periods of four hours each, three sub-periods for the daytime and three identical sub-periods for the nighttime.

Moreover, U.S. Pat. No. 1,500,701 discloses a watch having a 12-hour dial, wherein each hour of an 8-hour working period is subdivided into tenths, in order to simplify counting of the working hours per formed by employees.

However, none of the above known-art watches fully achieves the aim of regulating life according to modern rhythms, as in these watches time is always represented according to a conventional 12-hour scale.

The technical problem underlying the present invention is that of providing a watch allowing to overcome the drawbacks mentioned with reference to the known art.

Such problem is solved by a watch as above described, comprising a single path, with respect to which said movable pointing end is moved, which is provided with an initial position and a final position matching one with the other, wherein the run time of said path from the initial position to the final position, of said movable pointing end, is of eight hours, and wherein the watch further comprises identification means of an 8-hour period corresponding to said path which displays three different temporal conditions.

Within the scope of the same inventive concept, said problem is likewise solved by a watch comprising, on said dial, a single path provided with an initial and a final position separated one from the other, wherein the run time of said path from the initial position to the final position of said movable pointing end is of eight hours, said watch comprising springing back means to make said pointing hand spring back in the initial position once the final position has been reached, wherein said watch further comprises identification means of an 8-hour period corresponding to said path which displays three different temporal conditions.

The main advantage of the watch, according to one of the definitions of the present invention, lies in allowing a representation of the passing of time which is closer to the pace and uses of the daily life.

A remarkable advantage of psychophysical nature ensues therefrom, wherein the structure of said watch provides the user with an information giving a feeling of completeness and of fullness of time.

BRIEF DESCRIPTION OF THE DRAWINGS

The present invention will be disclosed hereinafter according to four embodiments thereof, given by way of example and not for limitative purposes with reference to the annexed drawings, wherein.

DETAILED DESCRIPTION OF THE INVENTION

With reference to the figures, four watches are represented, in particular of the wrist-watch type, with a detailed view of the dial thereof. Each watch is an embodiment of the invention.

Of course, the same inventive concept can anyhow be applied to other watch typologies: clock, table clock, vest-pocket watch and so on.

In the following description, similar components or anyhow performing a similar function are indicated with the same numeral reference for ease of interpretation.

Figure 1:
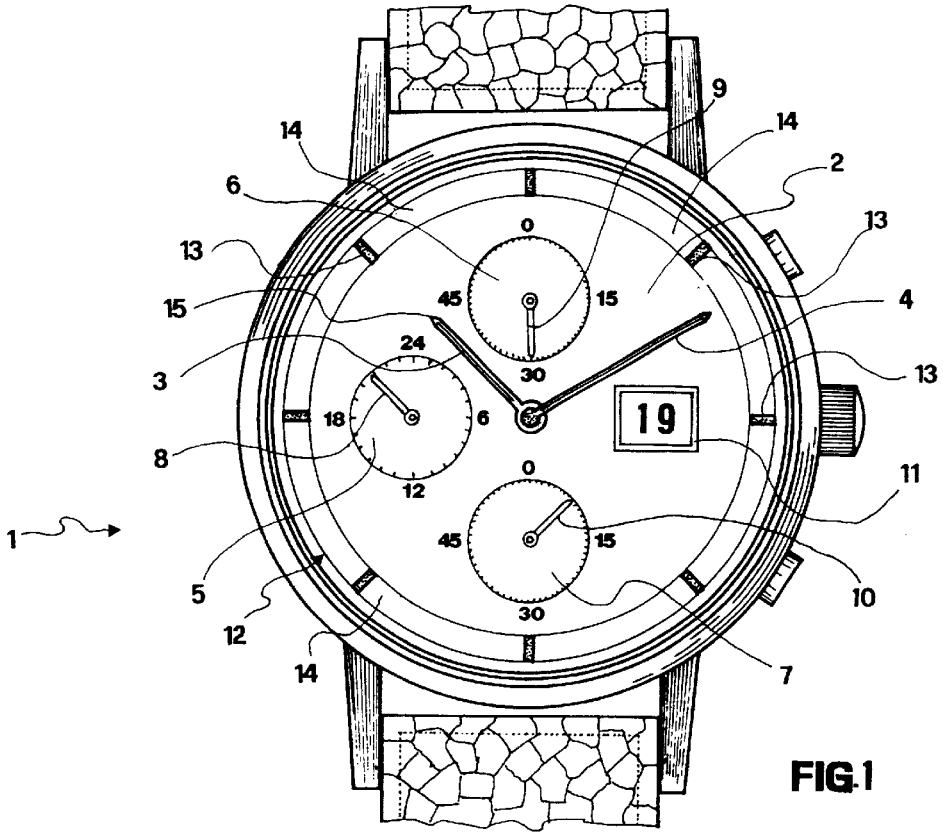
FIG. 1 shows a plan view of a watch according to a first embodiment of the present invention.

With reference to FIG. 1, a wrist-watch of the chronograph type is globally indicated with 1 and comprises a dial 2; a first hand member 3, pivoted to the centre of said dial 2 and meant to provide the information on the current hour; a second hand member 4, pivoted to the centre of said dial 2 and meant to provide the information on the current minute.

The dial 2 further comprises a first, a second and a third subdial, 5, 6, 7 provided with respective third, fourth, fifth hand member 8, 9, 10 to provide information on the current time, considered with the traditional division in 12/24 hours, the current second and for the possible performance of chronometrical functions.

Said dial 2 further comprises a calendar 11 of the traditional type, and a graduated circumferential path 12 having a plurality of indicator members 13 subdividing it into a corresponding number of sections 14.

The indicator members 13 represent different positions on said path 12 and on the dial 2. In particular, an indicator member 13 in a median position represents the initial position of said path 12 and, the path 12 being circumferential, also the final position thereof.

Each hand member, and particularly the first hand member 3, comprises a pointing end 15 that is movable with respect to said graduated circumferential path 12.

In the watch 1 according to the present invention, the run time of said pointing end 15 with respect to the path 12 from the initial position to the final position, i.e., for a whole revolution of the dial 2, is of eight hours.

Therefore, said path 12 comprises eight indicator members 13 and eight sections 14 identified by the former.

Figure 2:
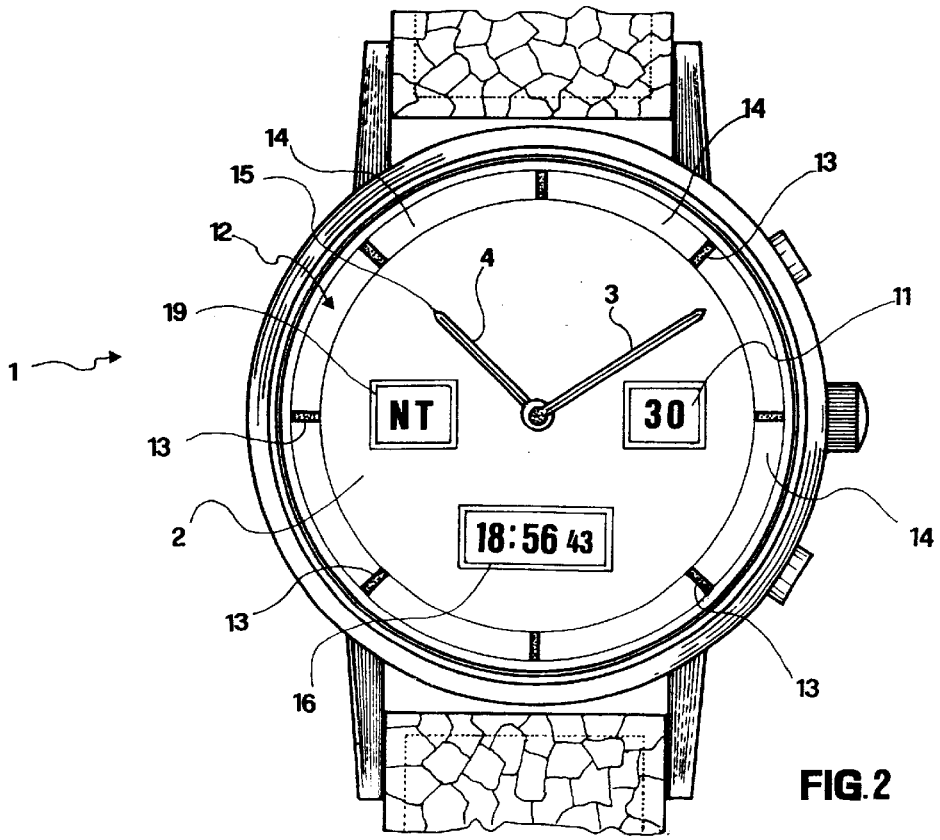
FIG. 2 shows a plan view of a watch according to a second embodiment of the present invention.

With reference to FIG. 2, a wrist-watch of the normal type is globally indicated with 1 and comprises a dial 2; a first hand member 3, pivoted to the centre of said dial 2 and meant to provide the information on the current hour; a second hand member 4, pivoted to the centre of said dial 2 and meant to provide the information on the current minute.

Said dial 2 comprises a calendar 11, of traditional type, and a graduated circumferential path 12 having a plurality of indicator members 13 dividing it into a corresponding number of sections 14.

On the dial 2, a digital display 16 is also comprised, reporting in digits the hour expressed according to the traditional system.

The indicator members 13 represent different positions on said path 12 and on the dial 2. In particular, an indicator member 13 in a median position represents the initial position of said path 12 and, the path 12 being circumferential, also the final position thereof.

Each hand member and particularly the first hand member 3 comprises a pointing end 15 that is movable with respect to said graduated circumferential path 12.

In the watch 1 according to the present invention, the run time of said pointing end 15 with respect to the path 12 from the initial position to the final position, i.e., for a whole revolution of the dial 2, is of eight hours.

Thus, said path 12 comprises eight indicator members 13 and eight sections 14 identified by the former.

On the dial 2, the watch 1 further comprises identification means of an 8-hour period corresponding to the completion of said path 12 by the pointing end 15.

Said identification means are capable of displaying three different time conditions, corresponding respectively to the working time, indicated with the initial WT, going from 8.00 a.m. to 4.00 p.m.; to the free time period, indicated with the initial FT, going from 4.00 to midnight; and to the night time, indicated with the initial NT in FIG. 2, going from midnight to 8.00 a.m.

In the present embodiment, said identification means comprise a window 18, obtained on the dial 2, and a release member 19, movable below the dial, changing its state every eight hours, in correspondence with the passing final—initial position, displaying the initial corresponding to the current time period.

Figure 3:
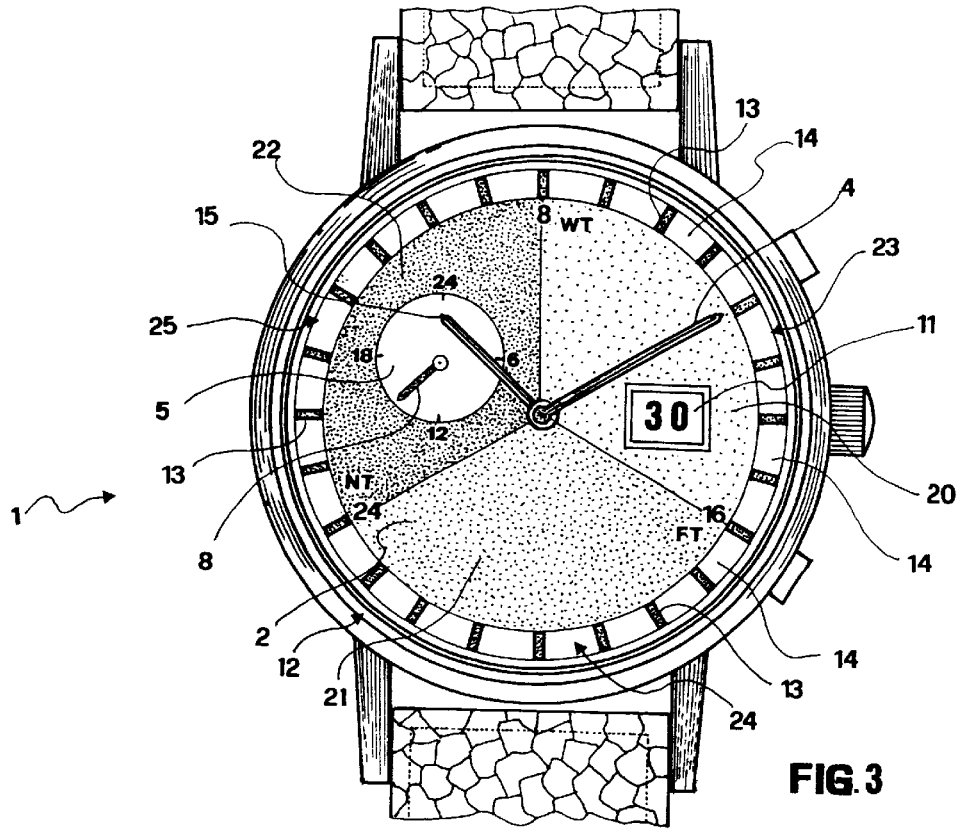
FIG. 3 shows a plan view of a watch according to a third embodiment of the present invention.

With reference to FIG. 3, a wrist-watch is globally indicated with 1 and comprises a dial 2; a first hand member 3, pivoted to the centre of said dial 2 and meant to provide the information on the current hour; a second hand member 4, pivoted to the centre of said dial 2 and meant to provide the information on the current minute.

Said dial 2 further comprises a calendar 11, of the traditional type; a first subdial 5 provided with a third hand member 8 for the representation of the traditional time, or, alternatively, of the current seconds; and a graduated circumferential path 12 having a plurality of indicator members 13 dividing it in a corresponding number of sections 14.

The indicator members 13 represent different positions on said path 12 and on the dial 2.

Each hand member, and in particular the first hand member 3, comprises a pointing end 15 that is movable with respect to said graduated circumferential path 12.

In the watch 1 according to the present invention, the run time of said pointing end 15 with respect to the path from the initial position to the final position, i.e., for a whole revolution of the dial 2, is of 24 hours.

In this connection, the path 12 comprises twenty-four indicator members 13 and twenty-four corresponding sections 14 identified by the former.

Further, the dial 2 is divided into a first sector 20, a second sector 21 and a third sector 22, corresponding respectively to said identification means of an 8-hour period.

In fact, said sectors 20, 21, 22 are all equal to each other: with a view angle of 120°, and each of them delimits an 8-hour period, with nine indicator members 13 and eight sections 14 per sector, with initial and final positions that are distinct for each total path section, indicated with 23, 24, 25, respectively, corresponding to each sector 20, 21, 22.

The division into sections in the present embodiment is graphically performed, directly on the dial 2. The initial position of the working time period (WT) corresponds to the median position on the dial 2.

The final position of each sector corresponds to the initial position of the subsequent sector.

Figure 4:
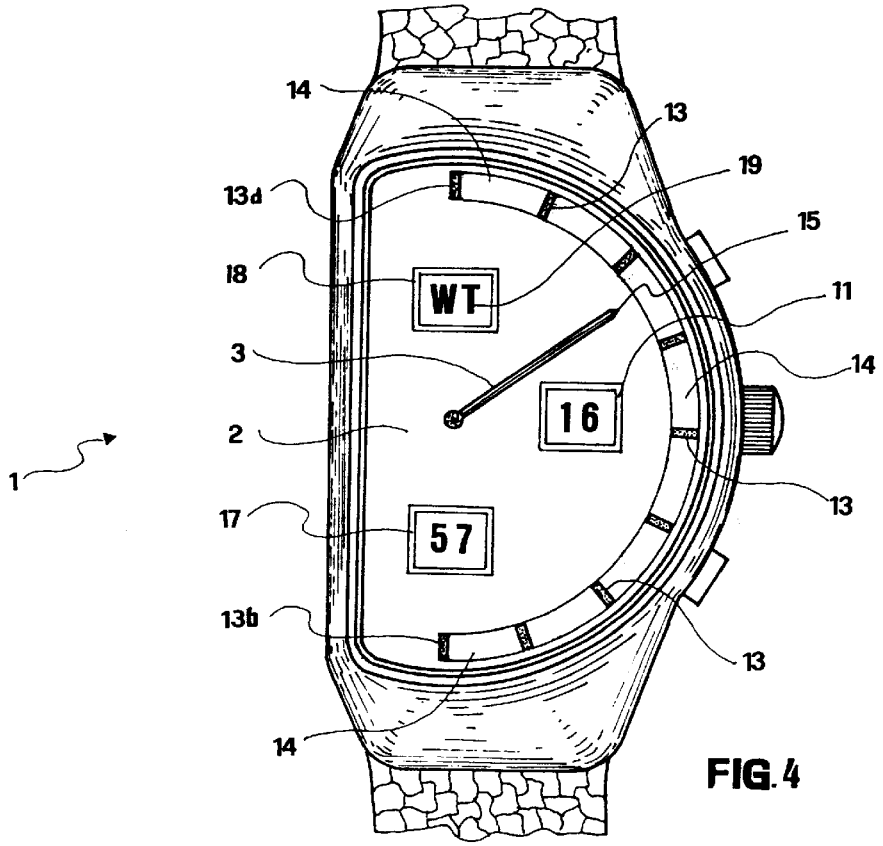
FIG. 4 shows a plan view of a watch according to a fourth embodiment of the present invention.

With reference to FIG. 4, a wrist-watch is globally indicated with 1 and comprises a dial 2; and a hand member 3, pivoted sideways with respect to said dial 2 and meant to provide the information on the current hour.

Said dial 2 further comprises a calendar 11, of the traditional type, and a graduated path 12 having a plurality of indicator members 13 subdividing it in a corresponding number of sections 14.

The watch 1 further comprises display means 17 of the current minutes related to the motion of said hand member 3.

The graduated path 12 extends over an open circle segment, substantially extending over 180°.

The indicator members 13 represent different positions on said path 12 and on the dial 2. In particular, an end indicator member 13*a* represents the initial position of said path 12 and an end indicator member 13*b* represents the final position of said path 12.

Each hand member, and particularly the first hand member 3 comprises a pointing end 15 that is movable with respect to said graduated circumferential path 12.

In the watch 1 according to the present invention, the run time of said pointing end 15 is of eight hours with respect to the path 12 from the initial position to the final position.

Thus, said path 12 comprises nine indicator members 13, 13*a*, 13*b* and eight sections 14 identified by the former.

Figure 5:
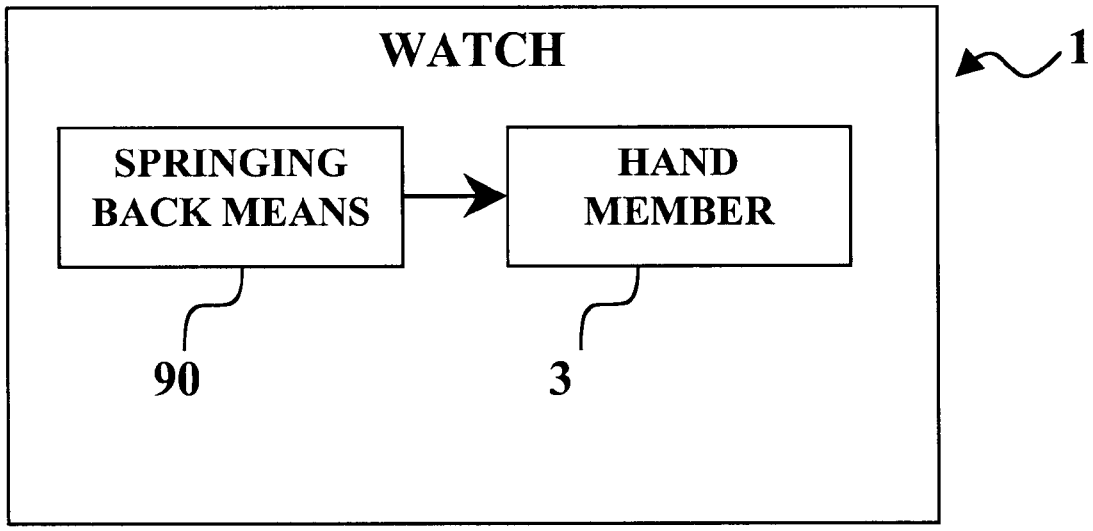
FIG. 5 shows a block diagram representation of a detail of the watch of FIG. 4.

The hand member 3 springs back to the initial position by means of springing back means 90 once the final position has been reached, as shown in FIG. 5.

On the dial 2, the watch 1 further comprises identification means of an 8-hour period corresponding to the completion of said path 12 by the pointing end 15.

Said identification means are capable of displaying three different time conditions, corresponding to the working time period, indicated with the acronym WT in FIG. 4, going from 8.00 a.m. to 4.00 a.m.; to the free time period, indicated with the initial FT, going from 4.00 p.m. to midnight; and to the night time period, indicated with the initial NT, elapsing from midnight to 8.00 a.m., respectively.

In the present embodiment, said identification means comprise a window 18, obtained on the dial 2, and a release member 19, movable below the dial, changing state every eight hours, in correspondence with the passing final—initial—position, displaying the sign corresponding to the current time period.

The parts of the watches of said embodiments that were not described can be made in a conventional way.

Further, it should be noted that such watches, among the various possible variants, can comprise other subdials, reporting e.g., the hour of other time zones, the Moon phases and so on.

Then, the traditional hands can also be replaced by different hand members, all however falling within the same protective scope.

Besides the aforecited advantages, this structural notion of a watch provides a time representation well suited to the circadian rhythms imposed by the modern lifestyles.

To the above-described watches, a man skilled in the art, in order to meet further and contingent needs, will be able to carry out several further modifications and variants, all however comprised within the protective scope of the present invention, as defined by the annexed claims.

What is claimed is:

1. A wrist-watch comprising:

a dial;

at least a hand member having a movable pointing end; and a single path, with respect to which said movable pointing end is moved, which is provided with an initial position and a final position matching one with the other, wherein run time of said path from the initial position to the final position of said movable pointing end is of eight hours, said watch further comprising identification means of an 8-hour period corresponding to said path, said identification means displaying three different temporal conditions.

2. The wrist-watch according to claim 1, wherein said identification means comprises a window, obtained on the dial, and a release member, movable below the dial, changing its state every eight hours, in correspondence with the passing final—initial position.

3. The wrist-watch according to claim 1, comprising display means of the traditional time.

4. The wrist-watch according to claim 1, comprising a calendar in correspondence of said dial.

5. The wrist-watch according to claim 1, wherein said path is graduated.

6. The wrist-watch according to claim 1, wherein said path is substantially circumferential.

7. The wrist-watch of claim 1, wherein said three different temporal conditions are work time, free-time, and night time.

8. The wrist-watch according to claim 1, wherein one displayed temporal condition of said three different temporal conditions is changed to another displayed temporal condition of said three different temporal conditions every eight hours.

9. A wrist-watch comprising:

a dial;

at least a hand member having a movable pointing end; and a single path, with respect to which said movable pointing end is moved, which is provided with an initial position and a final position separated one from the other, wherein run time of said path from the initial position to the final position of said movable pointing end is of eight hours, said watch comprising springing back means to make said pointing end spring back in the initial position once the final position has been reached, wherein said watch further comprises identification means of an 8-hour period corresponding to said path, said identification means displaying three different temporal conditions.

10. The wrist-watch according to claim 9, wherein said path extends over a circumferential segment.

11. The wrist-watch according to claim 9, comprising display means of the traditional time.

12. The wrist-watch according to claim 9, comprising a calendar in correspondence of said dial.

13. The wrist-watch according to claim 9, wherein said path is graduated.

14. The wrist-watch according to claim 9, wherein said identification means comprise a window, obtained on the dial, and a release member, movable below the dial, changing its state every eight hours, in correspondence with the passing final—initial position.

15. The wrist-watch of claim 9, wherein said three different temporal conditions are work time, free-time, and night time.

16. The wrist-watch according to claim 9, wherein one displayed temporal condition of said three different temporal conditions is changed to another displayed temporal condition of said three different temporal conditions every eight hours.

* * * * *